United States Patent [19]

Kuhlman

[11] Patent Number: 4,786,767

[45] Date of Patent: Nov. 22, 1988

[54] TRANSPARENT TOUCH PANEL SWITCH

[75] Inventor: Bruce Kuhlman, Redwood City, Calif.

[73] Assignee: Southwall Technologies Inc., Palo Alto, Calif.

[21] Appl. No.: 57,274

[22] Filed: Jun. 1, 1987

[51] Int. Cl.[4] ..... H01H 13/70

[52] U.S. Cl. ..... 200/5 A

[58] Field of Search ..... 200/5 A, 159 B, 52 R, 200/DIG. 1, 305, 317, 86 R; 307/116; 178/18; 340/365 R, 365 C, 365 P, 365 UL, 706, 711, 712; 361/212, 220

[56] References Cited

U.S. PATENT DOCUMENTS

| | | | |
|---|---|---|---|
| 3,757,322 | 9/1973 | Barkan et al. | 340/365 C |
| 4,085,302 | 4/1978 | Zenk et al. | 200/159 B X |
| 4,194,083 | 3/1980 | Abe et al. | 178/18 |
| 4,230,967 | 10/1980 | Holz et al. | 340/365 C |
| 4,423,299 | 12/1983 | Gurol et al. | 200/159 B |
| 4,567,480 | 1/1986 | Blanchard | 340/712 |
| 4,570,149 | 2/1986 | Thornburg et al. | 178/18 X |
| 4,636,582 | 1/1987 | Muriwaki et al. | 178/18 |
| 4,646,062 | 2/1987 | Arakawa | 200/159 B X |

*Primary Examiner*—J. R. Scott

*Attorney, Agent, or Firm*—Ciotti & Murashige, Irell & Manella

[57] ABSTRACT

An improved transparent touch panel membrane switch for use and shielding in front of a visual display terminal is disclosed. The switch is made up of a plurality of plastic sheets arrayed substantially parallel to one another in a sandwich configuration. The outermost of the sheets has an antireflective hardcoat. Two adjacent but spaced apart inner sheets provide the electrical contact through transparent low reflectance conductive metal coatings. The switch additionally contains a further inner antireflective transparent electrically conductive coating which provides shielding against the passage of electromagnetic and radio frequency interference through the membrane switch. The layers in this switch all contribute to a relatively low transmittance of back lighting from the visual display terminal but also significantly reduce reflectance such that the overall signal-to-noise ratio is substantially enhanced.

8 Claims, 2 Drawing Sheets

TRANSPARENT TOUCH PANEL SWITCH

BACKGROUND OF THE INVENTION

1. Field of the Invention

This invention relates to an improved touch panel membrane switch. More particularly, it relates to a transparent membrane switch having improved optical properties.

2. Prior Activities in the Field

Several flat panel switch mechanisms have been proposed. See, for example, the article "Touch screens diversify" by J. D. Logan in ELECTRONIC PRODUCTS, 28, 11 (Nov. 1, 1985) which describes capacitive, resistive membrane and LED or optical types of touch screen swtiches and the booklet MEMBRANE KEYBOARD DESIGN MANUAL distributed in 1983 by the Dorman Bogdonoff Corporation.

These switches share a number of characteristics and preferred applications. For one, they are basically two dimensional having a thickness of less than a millimeter and a length and width many times that size. They are usually multilayer and, in the case of capacitive and resistive membrane types, involve several electrically conductive layers. They all respond to finger touch. This response can take the form of deflecting one layer to make contact with another layer such as deflecting a top layer to contact a base so as to effect a physical engagement of electrical contacts or of deflecting a layer to bring about a measurable change in capacitance or resistance or the like.

It is often desirable to make the touch panel switches transparent so that they can be placed in front of an illumination source and back lit. In a very preferred application, the illumination source is a cathode ray tube and the switch is positioned directly in front of or adhered to the face of the cathode ray tube. This arrangement allows the user to activate the switch in direct response to information appearing through the switch from the cathode ray tube.

Representative patents in the area of touch panels and their use with cathode ray tube displays include U.S. Pat. Nos. 3,560,675; 3,673,327; 3,757,322; 4,110,749; 4,186,392; 4,220,815; 4,230,967; 4,305,071; 4,310,839; 4,346,376; 4,413,314; 4,423,299; 4,427,861; 4,449,029; 4,459,476; 4,484,179; 4,516,112; 4,517,559; 4,521,870; 4,542,375; 4,553,142 and 4,567,480.

These back-lit touch panel switches operate well in the absence of direct light. However, most settings where these switches are to be used do have direct light percent. In fact, in many settings, the touch panel itself carries fixed text which must be read with direct light in conjunction with the text passing through the touch panel. This can lead to problems. The layers commonly employed in touch panel switches are inherently reflective. In the case of the capacitive and resistive switches they include either a myriad of fine wires or they contain thin but conductive films of metal which can be very reflective. Thus, if adequate direct light is present to permit text printed on the touch panel to be readily read, there is often such a level of reflection that the information coming through the switch is not decifera-ble. This problem can be made worse if the touch panel is equipped with an electromagnetic shield, a radio frequency interference shield or an electrostatic discharge shield, all of which are becoming more prevalent in cathode ray tube device designs and all of which can contribute to undesired reflections.

A number of remedies to this problem have been proposed. One is to increase the brightness of the back-lighting cathode ray tube. This is often difficult and costly. Another has been to apply an antireflective coating or layer on the outside of the panel switch. This is probably the current method of choice.

It is an object of this invention to provide an improved touch panel membrane switch which operates with improved efficiency in conditions of simultaneous back light and direct light.

STATEMENT OF THE INVENTION

An improvement in transparent touch panel membrane switches has now been found. Stated briefly, this improvement is based on the finding that one can achieve superior performance in such switches by substantially increasing their absorption and thus substantially reducing the signal which they emit since the factors which reduce the signal can be controlled to reduce reflectance by an even greater factor so as to achieve an overall improvement in signal to noise ratio. This invention can take the form of a multilayer transparent touch panel membrane switch having a plurality of its layer surfaces carrying an antireflectance or low reflectance coating. These coatings sum to give an increase absorption but also sum to give a reduced reflectance and an enhanced signal to noise ratio.

Thus, in one aspect the present invention provides an improved transparent touch panel membrane switch for use in front of a cathode ray tube or other back light source. Such a switch is made up of a plurality of essentially two-dimensional sheets arrayed substantially parallel to one another in a sandwich configuration. Each of these sheets is itself a multilayer composite. The outermost of these sheets, that is the sheet closest to the viewer and furthest from the CRT or other source of back light, is constructed of flexible transparent plastic and has a diffuse hardcoat on at least those portions of its outer surface through which back light is to pass. The inner surface of the outermost sheet carries a low relectance transparent electrically conductive coating such as a low relectance transparent metal/metal oxide coating. The adjacent, i.e next inner, sheet has on its outer surface a low reflectance transparent electrically conductive coating. These two sheets are mechanically spaced from one another by a distance which can be locally traversed by finger tip pressure deformation of the outer of them so as to make local electrical contact between their conductive surfaces. The switch contains an additional low reflectance transparent electrically conductive surface. This surface is configured to be electrically couplable. This allows this surface to provide shielding against the passage of electromagnetic and radio frequency interference through the membrane switch and to provide electrostatic discharge protection. This shielding surface is located either on the inner surface of the inner sheet or on a surface of an additional sheet typically located yet closer to the back-light source. One or more of these various sheets also comprises a light absorption material. This can comprise a coating on one or more or the surfaces or can be dispersed through one or more of the transparent plastic substrates of the sheets.

The various layers in this configuration of switch all contribute to a relatively low transmittance of back lighting. However, they also significantly reduce reflectance such that the overall signal-to-noise ratio obtained with this switch is substantially enhanced.

DETAILED DESCRIPTION OF THE INVENTION

BRIEF DESCRIPTION OF THE DRAWINGS

In this specification, reference will be made to the accompanying drawings in which

FIG. 1 is a cross-sectional view of another embodiment of the touch panel switch of this invention;

DESCRIPTION OF PREFERRED EMBODIMENTS

Figure 1:
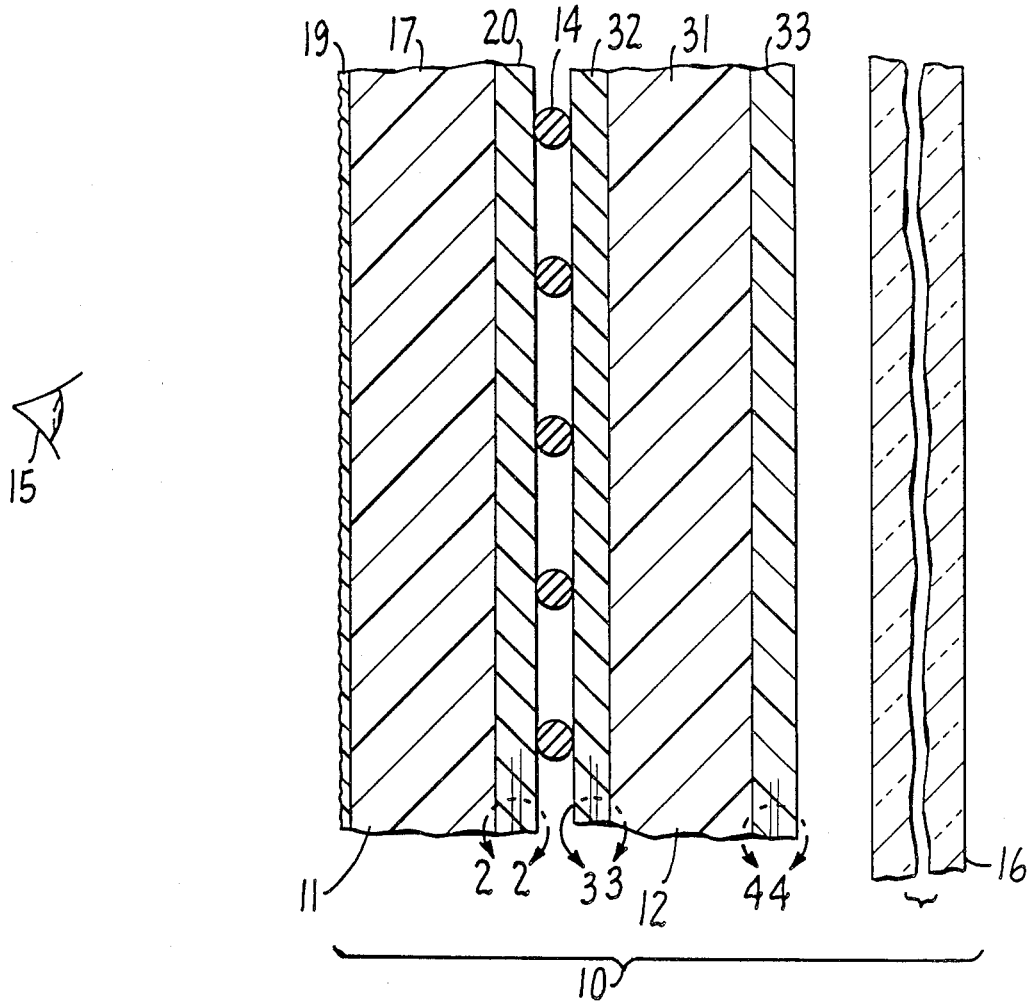
FIG. 1 is a cross-sectional view of a multilayer touch panel membrane switch of the present invention

The touch panel membrane switches of this invention are made up as multisheet sandwiches. In FIG. 1 a typical switch 10 is shown in cross-sectional view. This switch includes an outer sheet 11 and an inner sheet 12 separated by physical spacers 14. The "inner" and "outer" locations are determined with relation to the location of the observer 15 and a CRT facr or other backlight source 16.

Outer sheet 11 itself has three layers. These include a flexible plastic substrate 17 and an overlaying hardcoat 19. The hardcoat 19 is provided to enhance resistance to abrasion. It can, for example, be a cured silica hardcoat or an acrylic-based hardcoat. These types of hardcoats are "diffuse hardcoats" which means that they present a relatively mat finish. This serves to reduce specular reflections off of the outer surface of the switch to levels of 0.01 or lower, especially to levels of 0.005 or lower by scattering ambient light and also to reduce fingerprinting when the panel is touched. The amount of antireflective hardcoat should be in the range of from about 0.5 to about 20 mils, preferably from about 1 to about 10 mils and more preferably 1.5 to 8 mils. Within these ranges, reflections are cut down dramatically but the information coming through the membrane switch is still clear and unblurred.

The hardcoat can cover the entire surface of the outer layer. However, in many applications, the outer layer also carries graphics which may blank out substantial portions of the area of the outer layer 11. In this case, the diffuse hardcoat may, if desired, only cover those portions of the outer layer which are not blanked out and through which light passes.

The outer sheet 11 has a flexible plastic substrate 17. This can be formed of plasticized polymer such as polycarbonate, polyester, polyolefin, polyether sulfone or the like. Polycarbonate and the polyester polyehylene terephthalate (PET) are preferred outer sheet substrates because of their roughness and resistivity to chemicals and the like. PET is the most preferred substrate. Plastic substrate 17 has a thickness of from about 1 to about 50 mils and preferably from about 2 to about 25 mils and more preferably from about 3 to about 15 mils. Outer sheet 11 and preferably substrate 17 itself provides absorption of light such that it has a transmission value of from about 0.20 to about 0.80 and preferably from about 0.25 to about 0.70 and more preferably from about 0.30 to about 0.50. This absorption can be imparted to outer shell 11 by any of the methods known in the art for reducing light transmittance, including, without limitation, pigmenting or dying the plastic substrate, applying a pigment or dye overcoat, imparting circular polarizing properties to the layer of the thin-film absorption coating or the like. For simplicity, ease of handling and durability, pigmenting of the plastic substrate 17 is the generally preferred method of reducing transmittance of this outer sheet to the desired levels.

Figure 2:
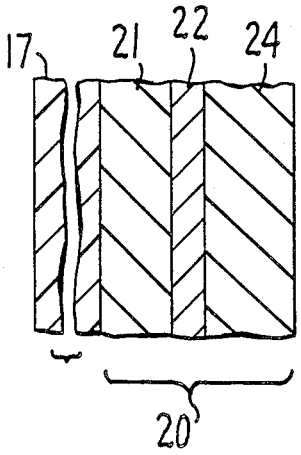
FIG. 2 is an expanded scale cross-sectional view taken at 2—2 of FIG. 1 of the inner surface of the outer layer of the switch shown in FIG. 1.

The inner surface of outer sheet 11 carries a transparent, electrically conductive, antireflection layer 20. Layer 20 can be a monolithic construction or it can itself be made up of more than one layer as is shown in FIG. 2. In FIG. 2, 17 is the plastic substrate and layer 20 is itself a three layer stack which includes a transparent metal oxide layer 21, a metal layer 22 and a second transparent oxide layer 24. Layer 20 can also be a transparent antireflective electrically conductive coating of conductive metal oxide. Both of these forms of conductors offer significant optical advantages over conventional metallic conductor films in that they are substantially less reflective but also substantially higher in transmissivity. They are characterized as providing reflectances of ambient light at levels of 0.1 (i.e. 10% of incident) or lower, preferably at levels of 0.01 or lower, especially at levels of 0.005 or lower.

Typical examples of monolithic layer 20 include a single indium-tin oxide layer of 500 Å to 2000 Å thickness, and the like. Examples of the multilayer stack embodiment of layer 20 include multilayer high index-low index layer of 500 Å to 2000 Å thickness including transparent dielectric-metal-dielectric stacks wherein 21 and 24 are the dielectric layers and 22 is the metal layer. In this embodiment, the metal layer is formed of a conductive metal and is from about 100 Å to about 500 Å in thickness with the dielectric layers being independently selected in the 100 Å to 1000 Å range. Representative metals include copper, nickel, silver gold and mixtures thereof and the like. Representative dielectrics include metal oxides such as $TiO_2$, PbO, $SnO_2$, $Bi_2O_3$, $ZrO_2$, $Fe_2O_3$, $InO_2$, and the like as well as metal sulfides such as ZnS.

This layer 20, whether presented as a monolith or as a multilayer stack, should have substantial electrical conductance, i.e., less than 200 ohms per square. A typical nonlimiting example would be 60 ohms per square.

The conductive layer 20 is a continuous layer of transparent conductor metal. Such layers can be laid down by a sputter deposit and vacuum deposit techniques. These materials can be applied onto the entire surface of the substrate and thereafter then can optionally be differentially etched from certain areas of the substrate by the use of masks and the like. The use of etching with masks allows electrical circuits to be set out on the substrate so as to provide a plurality of contact points, circuitry and the like as are needed to define a multiple switch design such as a keyboard or the like. The circuitry can run to conductive ink busbars and the like or to the edge of the film where they connect to other parts of the circuit which employ the signal created when the membrane switch is closed.

Figure 3:
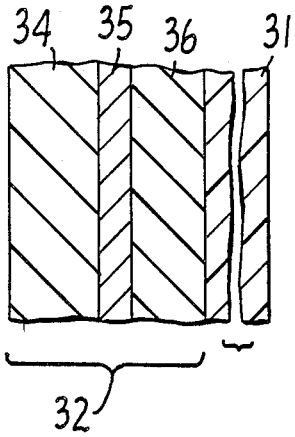
FIG. 3 is an expanded scale cross-sectional view taken at 3—3 of FIG. 1 of the outer surface of the outer layer of the switch shown in FIG. 1.

Skipping to sheet 12, it can be similar in structure and materials of construction to sheet 11. It includes a resilient flexible plastic substrate 31 with an antireflective transparent electrically conductive layer 32 on its outer surface. Substrate 31 is similar in materials and thickness to layer 17 in sheet 11. It can, if desired, contain pigments, dyes, or the like to reduce its light transmittance as is done with layer 11. Conductive layer 32, like layer 20, can be a monolithic structure or it can be a multilayer stack of dielectric layers 34 and 36 and metal layer 35 as shown in FIG. 3. In use, contact between conductive layers 20 and 32 comprises the switching event. Again, this conductive layer 32 can be continuous or discrete as called for by the switch design.

Sheets 11 and 12 are separated by a spacer 14. This spacer prevents the two conductor layers coming in contact unless layer 11 is deflected by finger pressure. Spacer 14 can be a sheet of nonconductor such as nonconductive plastic, or the like with a pattern of one or more cutouts for the switch points. Spacer 14 can be transparent if the entire switch is designed to be transparent or it can be opaque if transparency is sought only at the switch points. Polypropylene is a common nonconductive plastic material and polycarbonate and polyester materials can be used as well. Usually, the thickness of this spacer layer is from about 5 mils to about 20 mils, with thicknesses of from about 5 to about 15 mils being preferred. These thicknesses allow switch actuation to occur with minimal depression of the touch pad but effectively prevent premature or inadvertent contacting between the two conductor layers. As will be seen with reference to FIG. 5, this spacer function can also be provided by thick paint layers or the like adhered to one or both of surfaces 20 or 32 so long as the desired physical separation is achieved.

Figure 4:
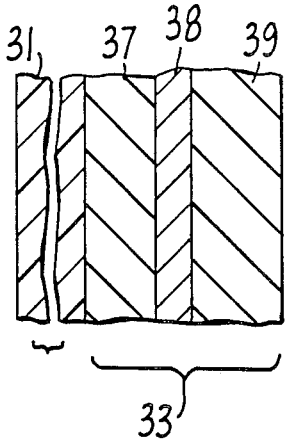
FIG. 4 is an expanded scale cross-sectional view taken at 4—4 of FIG. 1 of the inner surface of the inner layer of the switch shown in FIG. 1.

Skipping to the inside surface of sheet 12, it carries an electrically-couplable electromagnetic interference and radio frequency interference filter 33. This layer also provides a shield against electrostatic discharge. This layer is substantially the same as layers 20 or 32 in that it is an antireflective surface and can be a monolith or a multilayer stack. As shown in FIG. 4, the multilayer stack 33 can comprise a metal layer 38 bounded by dielectric layers 37 and 39. This filter layer 33, like layers 20 and 32, should be antireflective, so that the materials and constructions set forth for these layers are very suitable. Layer 33 is electrically connectable to a suitable ground such as through silver ink busbars or the like to provide the desired RFI, ESD and EMI filtering ability. Layer 33, as a monolith or as a multilayer stack can be made of the same materials employed in the other conductive layers.

It will be appreciated that it may be desirable to insert a protective plastic backing sheet between the filter layer 33 and the CRT tube 16 to prevent abrasion of the conductive layer which provides the filter. This protective plastic sheet can be formed of the polyester, polycarbonate or polypropylene materials used in other layers or could be any similar transparent plastic sheet.

Typically, sheets 11 and 12 and spacer 14 and the optional protective sheet are laminated to one another with adhesive to give a unit contact structure. The adhesive layers are not shown in the Figures but can be selected from the broad group of plastic adhesives known in the art.

Figure 5:
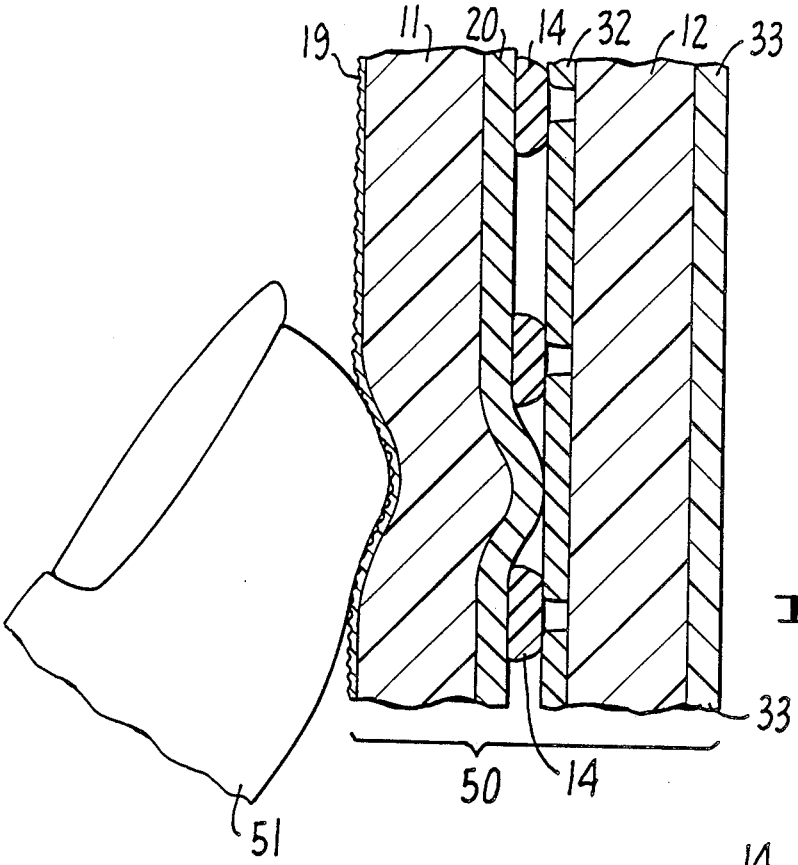

Turning to FIG. 5, an alternative embodiment 50 of the switches of this invention is shown. In addition, in this figure, the switch is shown in use with finger 51 depressing a region of the switch to effect electrical contact between the two conductive layers. In FIG. 5, a sheet 11 with diffuse hardcoat 19 and antireflective conductor 20 is as previously described. Similarly, sheet 12 is shown with filter 33. Conductor 32 is presented as a plurality of separate zones which are individually accessed by pressing particular regions on sheet 11. Spacer 14 is shown not as a separate layer but rather as a thick pattern printed on the inside surface of layer 20 so as to prevent contact between the two conductors except in cases where the same is intentionally effected pressing and deforming the outer sheet 11. It will be appreciated that the roles of layer 20 and layer 32 can be reversed and likewise that stencilled-on spacers 14 can be applied to layer 32 if desired.

Figure 6:
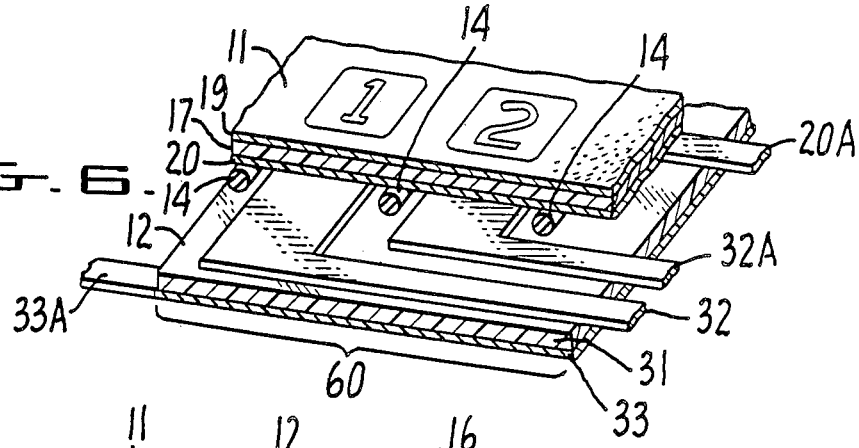
FIG. 6 is a partial isometric view of a switch of this invention.

Turning to FIG. 6, physical arrangement of the various layers in a membrane switch 60 is shown. Outer sheet 11 is shown with diffuse hardcoat 19, substrate 17 and conductive layer 20. This layer 20 is connected through conductor 20A to the circuit which employs the switch. Spacers 14 separate layer 20 from layer 32. Layer 32 is presented as several regions identified as 32 and 32A which are each connected into the switch circuit. Filter 33 is connected to ground through conductor 33A.

The touch panel switches of this invention can be clamped or adhered onto the face of a cathode ray tube and in this application give superior performance.

The superior optical performance of a touch panel switch of the present invention can be calculated based on observed transmittance and reflectance values for the various layers. A panel as shown in FIG. 1 can be prepared having the components shown in Table 1

TABLE 1

| Layer Number | Material |
|---|---|
| 19 | 3 mils silica diffuse hardcoat |
| 17 | pigmented polyethylene terphthalate polyester (40% transmittance neutral grey) (13 mils) |
| 20 | 1200Å Indium-Tin Oxide |
| 32 | 1200Å Indium-Tin Oxide |
| 31 | polyethylene terphthalate polyester (13 mils) |
| 33 | Multilayer stack (Altair TM -M-20) <2000Å |

For purposes of comparison, a system made up of 2 sheets of uncoated 5 mil polyester is used.

Figure 7:
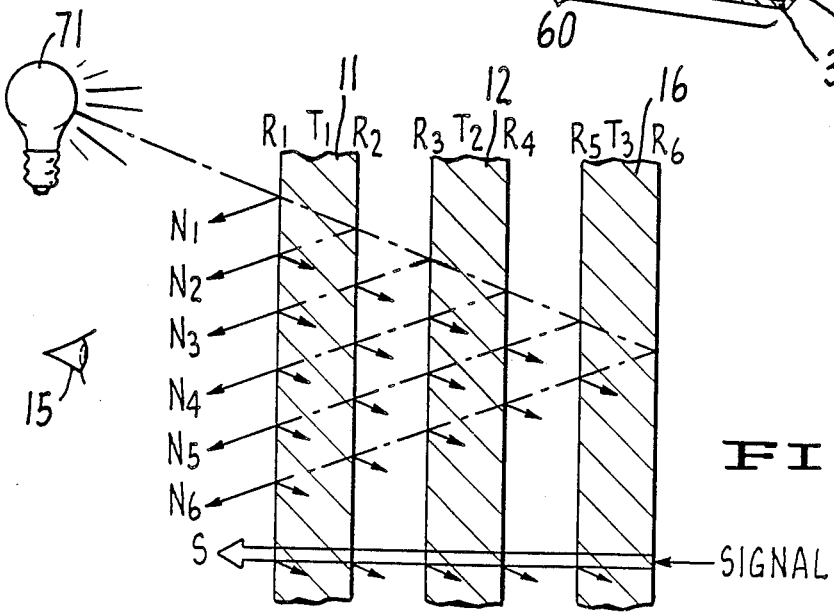
FIG. 7 is a schematic representation of the optical signal and interference present in a membrane switch. This representation is used in a mathematical model for calculating switch performance.

These two switch constructions are compared in a mathematical model based on the relationships shown in FIG. 7. In this model the total reflectance of ambient light from source 71 off of the various surfaces of sheets 11 and 12 and CRT tube 16. In this model these reflectance parameters are determined from the reflectance values ($R_1$, $R_2$, etc) for each of the surfaces and from the transmittance values ($T_1$, $T_2$, etc) for each of the sheets and summed as $N_1$ plus $N_2$, etc. according to the following formulae:

$$N_1 = R_1(LS)$$
$$N_2 = R_2(1-R_1)^2(T_1)^2(LS)$$
$$N_3 = R_3(1-R_1)^2(1-R_2)^2(T_1)^2(LS)$$
$$N_4 = R_4(1-R_1)^2(1-R_2)^2(1-R_3)^2(T_1)^2(T_2)^2(LS)$$
$$N_5 = R_5(1-R_1)^2(1-R_2)^2(1-R_3)^2(1-R_4)^2(T_2)^2(LS)$$

$N_6 = R_6(1-R_1)^2(1-R_2)^2(1-R_3)^2(1-R_4)^2(1-R_5)^2(T_1)^2(T_2)^2(T_3)^2(LS)$

TOTAL NOISE $= N_1 + N_2 + \ldots N_6$

SIGNAL $= (1-R_5)(1-R_4)(1-R_3)(1-R_2)(1-R_1)(T_1)(T_2)(T_3)(P)$

SIGNAL TO NOISE $= \frac{S}{N}$ $R_1$=REFLECTION FROM FIRST SURFACE (TOUCH-PANEL)

$R_2$=REFLECTION FROM SECOND SURFACE (TOUCH-PANEL)

$R_3$=REFLECTION FROM THIRD SURFACE (TOUCH-PANEL)

$R_4$=REFLECTION FROM FOURTH SURFACE (TOUCH-PANEL)

$R_5$=REFLECTION FROM FIFTH SURFACE (FACE PLATE-CRT)

$R_6$=REFLECTION FROM SIXTH SURFACE (PHOSPHOR LAYER)

$T_1$=INTERNAL TRANSMISSIONOF FIRST PANEL SHEET $T_2$=INTERNAL TRANSMISSION OF SECOND PANEL SHEET $T_3$=INTERNAL TRANSMISSION OF THIRD PANEL SHEET

LS=AMBIENT LIGHT SOURCE OUTPUT MEASURED AT DISPLAY FACE

P=DISPLAY OUTPUT (PHOSPHOR)

N=NOISE OR TOTAL REFLECTIONS FROM SYSTEM

S=SIGNAL OR TOTAL PHOSPHOR EMITTED LIGHT

This value is compared with the transmittance of signal from the phosphor screen of the CRT to give a signal to noise ratio.

The light emitted by the phosphor of the cathode ray tube (P) is given a brightness of 1.000 and the ambient light (LS) falling on the face of the membrane switch is given a value of 1.000. The values for the varous reflectances and tranmittances are as given in Table 2.

TABLE 2

| Variables | Signal/Noise Results Touch Panel: Variable Values (Uncoated 5 mil Pet) | Variable Values (New Touch Panel) |
|---|---|---|
| $R_1$ | 0.0585 | 0.003 (specular) |
| $R_2$ | 0.0585 | 0.003 |
| $R_3$ | 0.0585 | 0.003 |
| $R_4$ | 0.0585 | 0.003 |
| $R_5$ | 0.0425 | 0.0425 |
| $R_6$ | 0.5000 | 0.5000 |
| $T_1$ | 0.9870 | 0.4000 |
| $T_2$ | 0.9870 | 0.8500 |
| $T_3$ | 0.6000 | 0.6000 |
| LS | 1.0000 | 1.0000 |
| P | 1.0000 | 1.0000 |

| CALCULATED VALUES | | |
|---|---|---|
| N | 0.314 | 0.028 |
| S | 0.733 | 0.322 |

-continued

| CALCULATED VALUES | | |
|---|---|---|
| S/N | 2.330 | 11.610 |

These calculations show that the untreated standard has over twice as much signal as the system of the invention. However, the system of the invention with its multiple reflectance reducing treatment or its internal layers has less than one tenth the "noise" such that the signal to noise ratio improves from 2.33 to 11.61, an improvement of about 400%.

What is claimed is:

1. A transparent non-capacitive touch membrane switch for use in front of a cathode ray tube comprising two essentially two-dimensional sheets arrayed substantially parallel to one another in the outer sheet/inner sheet sandwich configuration, the outer sheet having a light transmission value of from about 0.20 to about 0.80 and comprising a flexible transparent plastic substrate having on at least a portion of its outer surface a diffuse hardcoat and on its inner surface a first antireflective transparent electrically conductive coating, and the inner sheet comprising a flexible transparent plastic substrate having on its outer surface a second antireflective transparent electrically conductive coating and on its inner surface a third antireflective transparent electrically conductive coating, with the inner and outer sheets being mechanically spaced from one another by spacer means to a distance which can be locally traversed by finger tip pressure deformation of the outer sheet so as to make electrical contact between first and second electrically conductive coatings so as to provide an electrical switching event and with the third antireflective transparent electrically conductive coating being electrically grounded so as to provide shielding against the passage of electromagnetic and radio frequency interference through said membrane switch.

2. A transparent touch panel membrane switch of claim 1 wherein the outer sheet has a light transmission value of from about 0.25 to about 0.70.

3. The transparent touch panel membrane switch of claim 1 wherein the spacer means is a perforated nonconductive plastic spacer sheet.

4. The transparent touch panel membrane switch of claim 1 wherein the spacer means is a layer of a nonconductive substance applied to either the first or second conductive coating.

5. The transparent touch panel membrane switch of claim 1 wherein the three antireflective transparent electrically conductive coatings are independently selected from among monolithic layers of conductive metal oxides and triple layer stacks of dielectric-metal-dielectric.

6. The transparent touch panel membrane switch of claim 5 wherein the three antireflective transparent electrically conductive coatings are monolithic layers of conductive metal oxides.

7. The transparent touch panel membrane switch of claim 5 wherein the three antireflective transparent electrically conductive coatings are triple layer stacks of dielectric-metal-dielectric.

8. The transparent touch panel membrane switch of claim 5 wherein the three antireflective transparent electrically conductive coatings each have a reflectance of ambient light of less than 0.1.

* * * * *